US009816262B2

(12) United States Patent
Hou et al.

(10) Patent No.: US 9,816,262 B2
(45) Date of Patent: Nov. 14, 2017

(54) PRECAST MODULAR CONCRETE WALL PANEL, SYSTEM THEREOF, AND METHOD OF CONSTRUCTION

(71) Applicants: Architectural Design and Research Institute of Tsinghua University, Beijing (CN); Javita (Shanghai) New Energy Investment Co., Ltd., Shanghai (CN); Jianqun Hou, Beijing (CN); Yazhi Wu, Shanghai (CN)

(72) Inventors: Jianqun Hou, Beijing (CN); Yazhi Wu, Shanghai (CN)

( * ) Notice: Subject to any disclaimer, the term of this patent is extended or adjusted under 35 U.S.C. 154(b) by 0 days.

(21) Appl. No.: 14/392,385

(22) PCT Filed: Dec. 16, 2014

(86) PCT No.: PCT/CN2014/093996
§ 371 (c)(1),
(2) Date: Mar. 28, 2016

(87) PCT Pub. No.: WO2015/090190
PCT Pub. Date: Jun. 25, 2015

(65) Prior Publication Data

US 2017/0002558 A1 Jan. 5, 2017

(30) Foreign Application Priority Data

Dec. 16, 2013 (CN) ..... 2013 1 0687043
Dec. 16, 2013 (CN) ..... 2013 1 0688094
Dec. 16, 2013 (CN) ..... 2013 1 0690173

(51) Int. Cl.
*E04B 1/04* (2006.01)
*E04C 2/06* (2006.01)
(Continued)

(52) U.S. Cl.
CPC ..... *E04B 1/043* (2013.01); *E04B 1/04* (2013.01); *E04B 1/61* (2013.01); *E04C 2/06* (2013.01);
(Continued)

(58) Field of Classification Search
CPC ... E04B 1/043; E04B 1/61; E04B 1/04; E04B 2103/02; E04C 2/30; E04C 2/288; E04C 2/06; E04C 2103/02
(Continued)

(56) References Cited

U.S. PATENT DOCUMENTS 5,146,721 A * 9/1992 Candiracci ..... E04B 2/847 181/284
5,927,032 A * 7/1999 Record ..... E04C 2/288 52/284

(Continued)

*Primary Examiner* — Brian Glessner
*Assistant Examiner* — Adam Barlow
(74) *Attorney, Agent, or Firm* — Charles Liu

(57) ABSTRACT

The present invention provided a precast modular concrete wall panel having a rectangular wall body with an upper slot and two side slots, and the wall body can further include an insulating layer and a decorative layer, and can contain a sandwich layer embedded in the concrete structure. The wall panels may be used with wall columns, wall corners and other components to form a wall panel system and further to form a building of frame structure or frame-share wall structure. Such wall panels have advantageous structural features and thus can be cost effectively prefabricated, and the construction process using such panel system can be performed with high efficiency.

7 Claims, 11 Drawing Sheets

(51) Int. Cl.
*E04B 1/61* (2006.01)
*E04C 2/288* (2006.01)
*E04C 2/30* (2006.01)

(52) U.S. Cl.
CPC ..... *E04C 2/288* (2013.01); *E04C 2/30* (2013.01); *E04B 2103/02* (2013.01)

(58) Field of Classification Search
USPC ..... 52/311.1, 311.2, 309.15, 309.17, 582.1, 52/586.1, 586.2
See application file for complete search history.

(56) References Cited

U.S. PATENT DOCUMENTS

| | | | | |
|---|---|---|---|---|
| 5,966,896 | A * | 10/1999 | Tylman | E04C 2/2885 52/309.12 |
| 6,725,616 | B1 * | 4/2004 | Pease | E04B 1/762 52/309.12 |
| 8,424,261 | B2 * | 4/2013 | Collier | E04B 2/18 52/309.12 |
| 8,820,024 | B1 * | 9/2014 | Abdullah | E04B 2/08 52/561 |
| 2003/0046895 | A1 * | 3/2003 | Haffner | B32B 3/08 52/745.19 |
| 2003/0167715 | A1 * | 9/2003 | Messenger | E04C 2/044 52/309.12 |
| 2003/0167716 | A1 * | 9/2003 | Messenger | E04C 2/044 52/309.12 |
| 2011/0258944 | A1 * | 10/2011 | Radoane | E04B 2/58 52/62 |

* cited by examiner

A-A

B-B

C-C

PRECAST MODULAR CONCRETE WALL PANEL, SYSTEM THEREOF, AND METHOD OF CONSTRUCTION

FIELD OF THE INVENTION

The present invention generally relates to the field of architectural construction and, more particularly, to a precast modular concrete wall panel, system of such wall panels, and method of construction.

BACKGROUND OF THE INVENTION

Frame wall and frame-shear wall structures are common structural types in architectural design and construction. For constructing such structures, conventional processes of concrete casting often require on-site reinforcement bar wiring, template or mould assembling and dissembling prior and after concrete casting step. Such on-site processes are rather labor intensive and time consuming.

Precast modular units may be used for improve the efficiency of fabrication and construction. However, current art has not provided precast modular concrete wall panels and system with the structural features and process convenience as disclosed herein.

SUMMARY OF THE INVENTION

The present invention is directed to provide a precast modular concrete wall panel, system thereof, and method of construction.

The present invention provided a precast modular concrete wall panel, comprising: a rectangular body, having a first face and a second face, an upper end and a lower end, and a first side and a second side, wherein an upper slot is formed along the upper end, and a first and second side slots are respectively formed along the first and second sides, and the body has a concrete structure with a plurality of steel bars for reinforcement.

The precast modular concrete wall panel may further comprise an insulating layer attached on the second face, and a decorative layer attached on the insulating layer.

The precast modular concrete wall panel may further comprise a sandwich layer, embedded in the concrete structure between the first face and the second face.

The present invention provided also a modular concrete wall panel system, comprising: a plurality of modular concrete wall panels, wall columns, floor templates and other components.

The present invention provided also a method for fabricating the modular concrete wall panels, the wall panel system, and buildings of frame structure or frame-share wall structure.

The precast modular concrete wall panels, as described herein, have advantageous structural features and thus can be cost effectively prefabricated. The on-site construction process of the wall panel system and corresponding building structure can be performed with high efficiency and low costs.

DETAILED DESCRIPTION OF THE EMBODIMENTS

Figure 1A:
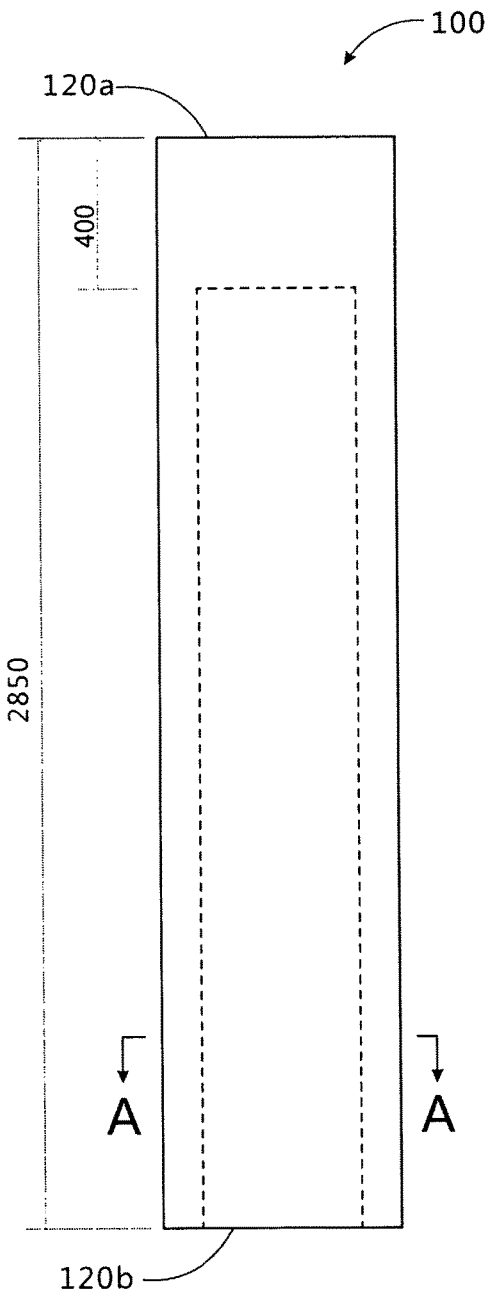
FIGS. 1A-1F are respectively front view, side view, top view, cross-section view, bottom view, and perspective view of a precast modular concrete wall panel in accordance with an embodiment of the present invention, wherein the wall panel has an upper slot and two side slots.
Figure 1B:
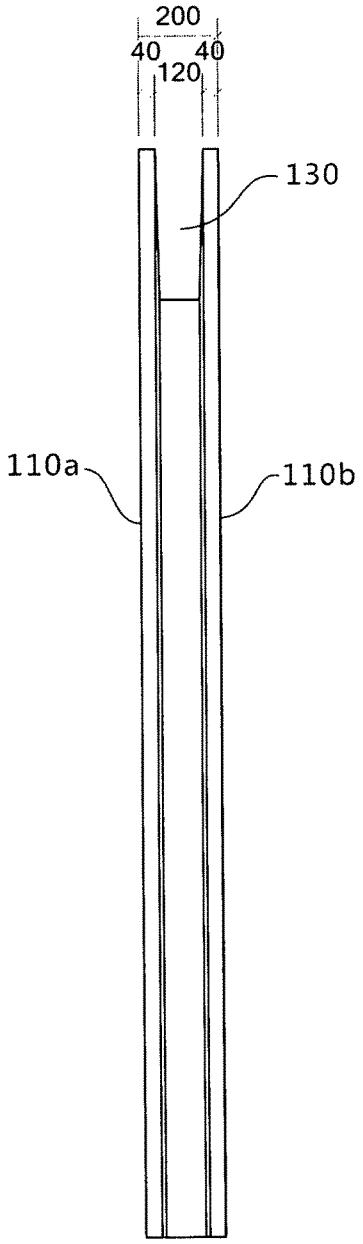

Representative embodiments of the invention are explained below in detail. It is to be understood, however, that the present invention is not limited in its scope explained in the description or illustrated in the drawings. In the drawings, for convenience, similar components or parts have been marked with similar numerals.

FIGS. 1A-1F illustrates an embodiment of the invention, the precast modular concrete wall panel 100, comprising: a rectangular body, having a first face 110*a* and a second face 110*b*, an upper end 120*a* and a lower end 120*b*, and a first side and a second side, wherein an upper slot 130 is formed along the upper end 120*a*, and a first and second side slots 140 are respectively formed along the first and second sides, and the body has a concrete structure with a plurality of steel bars therein for reinforcement.

The upper slot 130 runs through the entire length of the upper end 120*a*, the side slots 140 run through the entire length of the sides, respectively, such that the upper slot 130 is connected to each of the side slots 140.

The width and depth of the slots may vary based on actual needs. In a preferred embodiment, the upper slot 130 is greater in the depth of slot comparing to the side slots 140.

The upper slot 130 and the side slots 140 have independently a cross-section shape of, for example, trapezoidal, rectangular, circular or triangular.

FIGS. 2A-2F illustrates another embodiment, the precast modular concrete wall panel 200, further comprising: an insulating layer 260 attached on the second face 110*b*, and a decorative layer 270 attached on the insulating layer 260, in addition to the components shown in FIGS. 1A-1F.

In two sides of the insulating layer 260 are formed two side grooves 265, which have a cross-section shape of, for example, semicircular, rectangular, trapezoidal or triangular.

The insulating layer 260 can be made of any insulating or anti-flaming materials, preferably polystyrene or phenol formaledlyde foam.

The decorative layer 270 can be made of any materials which have functions for decoration or for both decoration and insulation.

FIGS. 3A-3F illustrates another embodiment of the invention, the precast modular concrete wall panel 300, further comprising: a sandwich layer 345, in addition to the components shown in FIGS. 2A-2F.

Figure 3A:
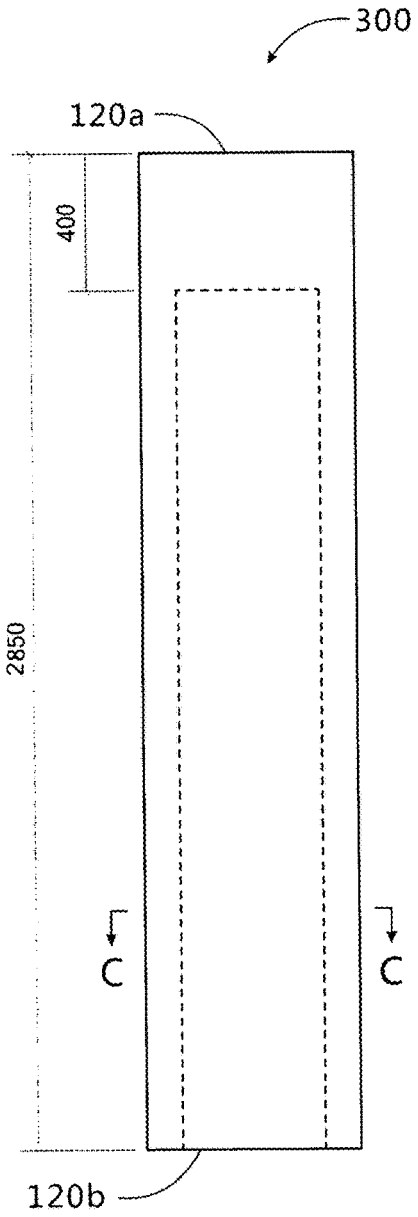
FIGS. 3A-3F are respectively a front view, side view, top view, cross-section view, bottom view, and perspective view of a precast modular concrete wall panel in accordance with yet another embodiment of the present invention, wherein the wall panel, as compared to that of FIGS. 2A-2F, further includes a sandwich layer embedded therein but with exposure of all four edges, i.e., two end edges and two side edges.
Figure 3B:
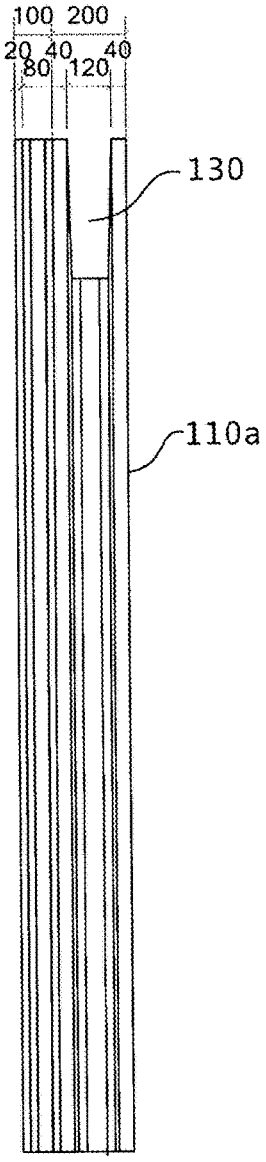
Figure 3C:
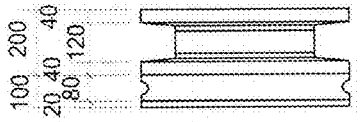
Figure 3D:
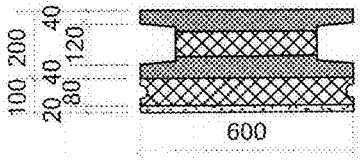
Figure 3E:
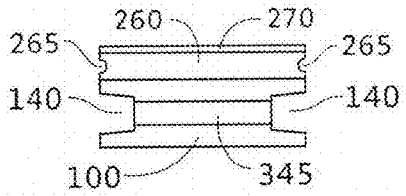
Figure 3F:
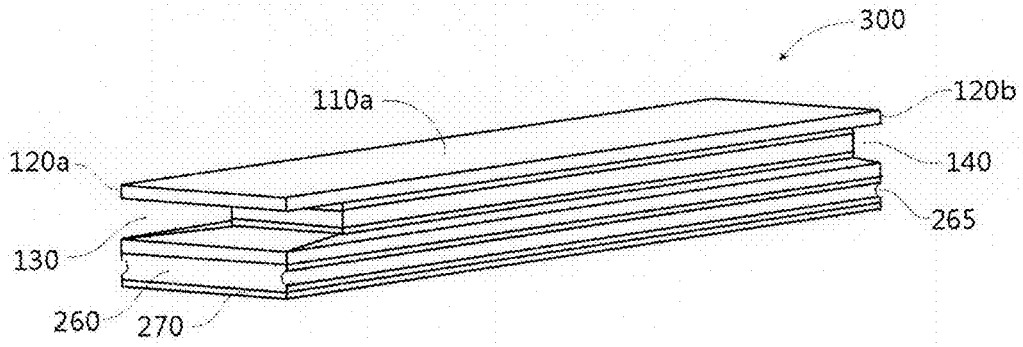
Figure 3G:
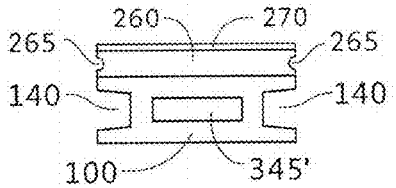
FIG. 3G is a cross-section view of a precast modular concrete wall panel in accordance with yet another embodiment of the present invention, wherein, as compared to the wall panel shown in FIG. 3D, the sandwich layer has exposure of only two side edges.

The sandwich layer 345 is embedded in the concrete structure between the first face 110*a* and the second face 110*b*, and can be positioned across the entire body of the panel (see 345 in FIG. 3E) or positioned across only a partial body of the panel (see 345' in FIG. 3G).

Figure 3H:
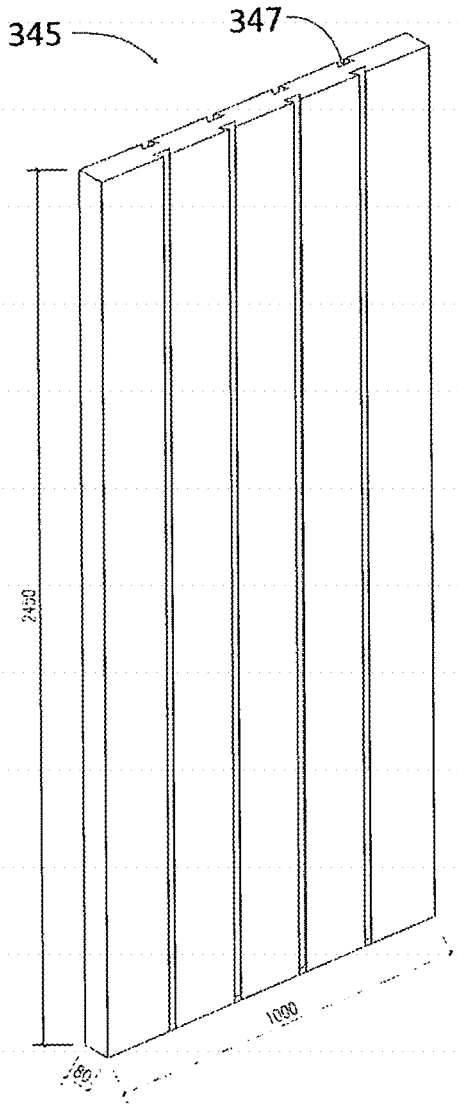
FIG. 3H is a perspective view of a unit of sandwich layer.

Preferably, as shown in FIG. 3H, a plurality of longitudinal dovetail grooves 347 are formed in two faces of the sandwich layer 345, such that, during the prefabricating process, concrete can be poured into the grooves for a tight binding.

The sandwich layer 345 can be formed of any suitable lightweight materials, preferably, having insulating function, such as, polystyrene or phenol formaledlyde foam.

Figure 4A:
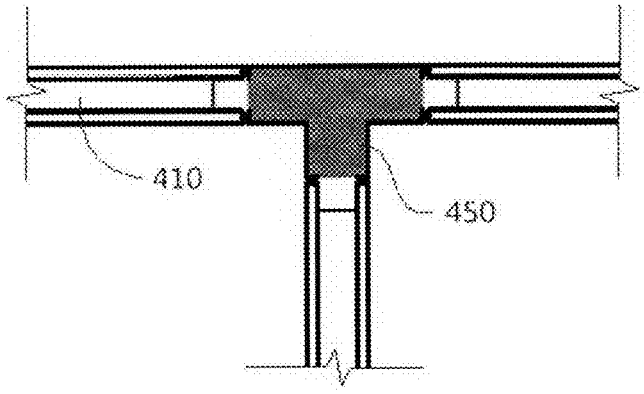
FIG. 4A is a cross-section view showing a precast modular concrete wall panel of FIGS. 1A-1F connected side by side with a wall column.

FIG. 4A illustrates a precast modular concrete wall panel 410 connected side by side with a wall column 450. A side of the wall panel 410 is positioned next to a side of the wall column 450 forming a channel there between, and the channel can be installed with a plurality of steel bars extending upwardly and poured into with concrete to secure a solid connection.

Figure 4B:
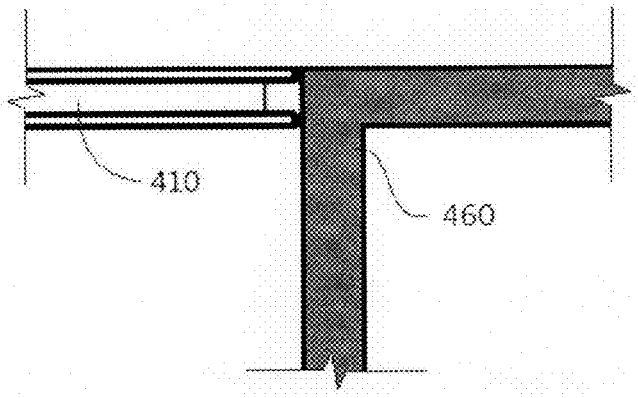
FIG. 4B is a cross-section view showing a precast modular concrete wall panel of FIGS. 1A-1F connected side by side with a shear wall.

FIG. 4B illustrates a precast modular concrete wall panel 410 connected side by side with a shear wall unit 460. A side of the wall panel 410 is positioned next to a side of shear wall unit 460 forming a channel there between, the channel can be installed with a plurality of steel bars extending upwardly, and into the channel is poured with concrete to secure a solid connection.

Figure 4C:
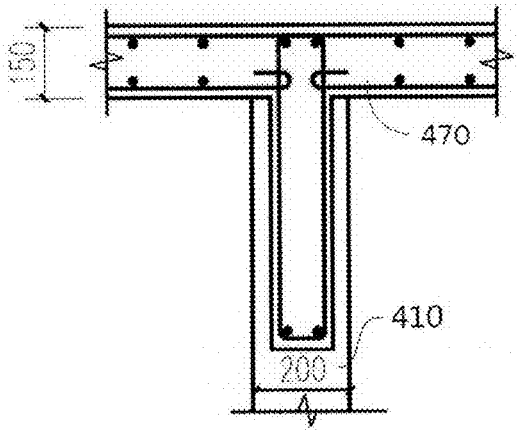
FIG. 4C is a cross-section view showing a precast modular concrete wall panel of FIGS. 1A-1F connected through the upper slot upwardly with a floor structure.

FIG. 4C illustrates a precast modular concrete wall panel 410 connected through the upper slot upwardly with a floor structure 470. The steel bars placed in the upper slot of the wall panel 410 can be coupled with the steel bars of the floor unit 470 and poured into with concrete to secure a solid connection.

Figure 1C:
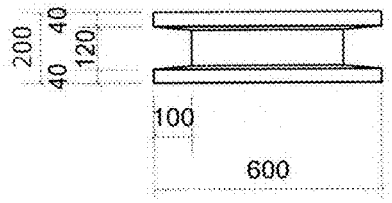
Figure 1D:
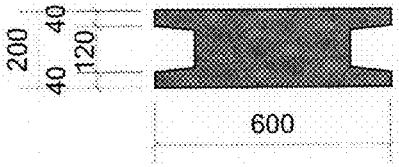
Figure 1E:
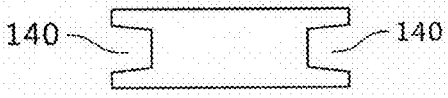
Figure 1F:
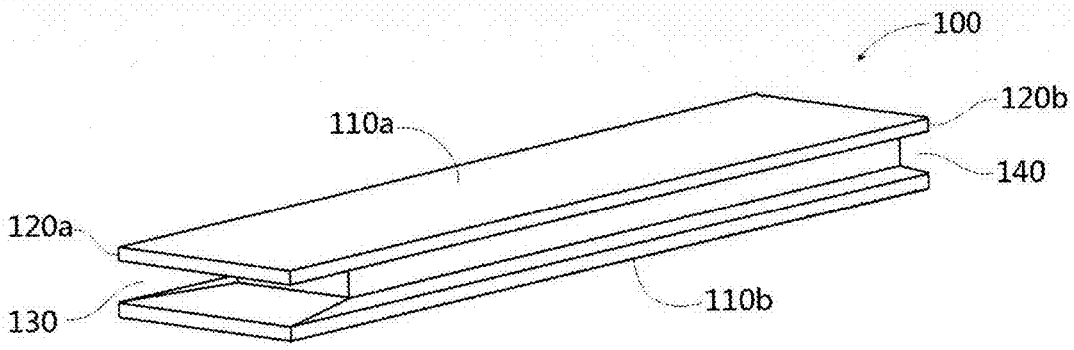
Figure 2A:
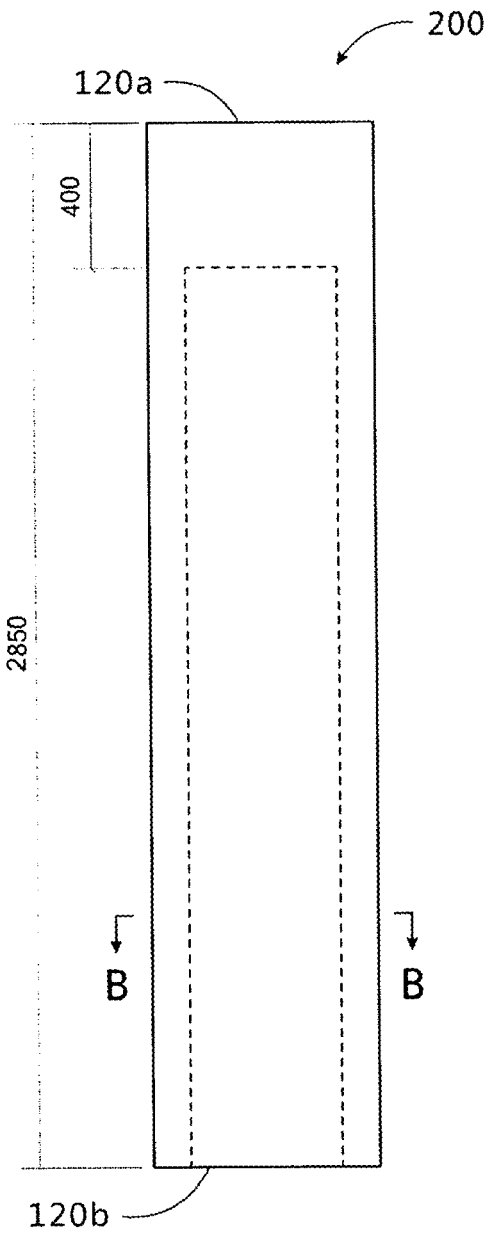
FIGS. 2A-2F are respectively a front view, side view, top view, cross-section view, bottom view, and perspective view of a precast modular concrete wall panel in accordance with another embodiment of the present invention, wherein the wall panel, as compared to that of FIGS. 1A-1F, further includes an insulating layer and a decorative layer.
Figure 2B:
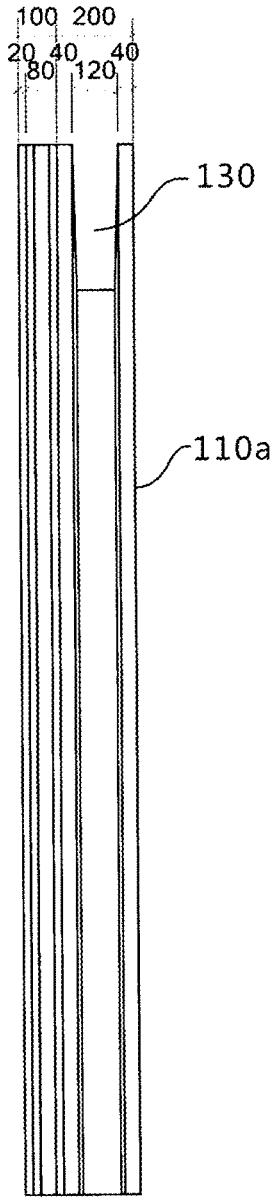
Figure 2C:
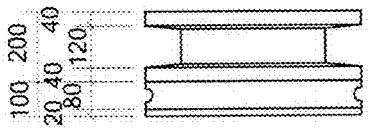
Figure 2D:
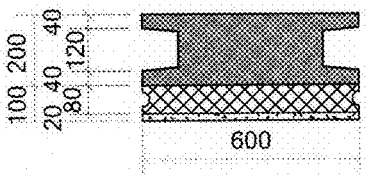
Figure 2E:
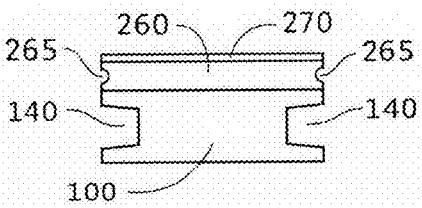
Figure 2F:
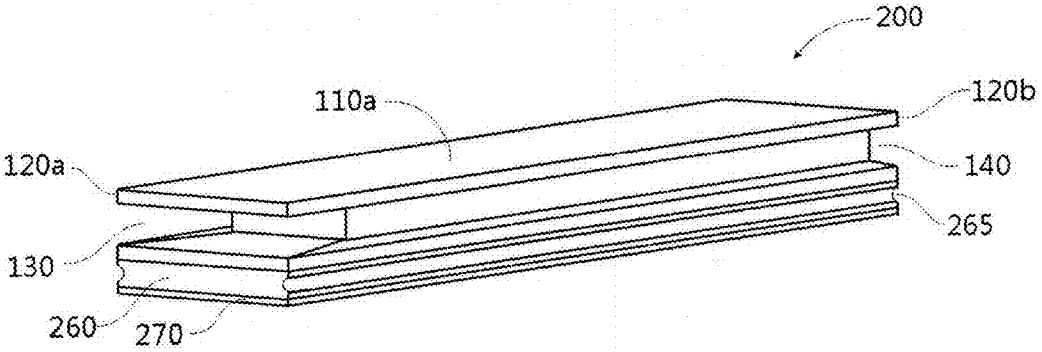

In the illustration of drawings, the components are marked with some particular sizes. In the embodiment of FIG. 1C, for example, the wall panel is marked with a width of 600 mm. It is understood that, however, the width may be changed or modified if needed to any suitable ones, for example, 1,200 mm.

Figure 5A:
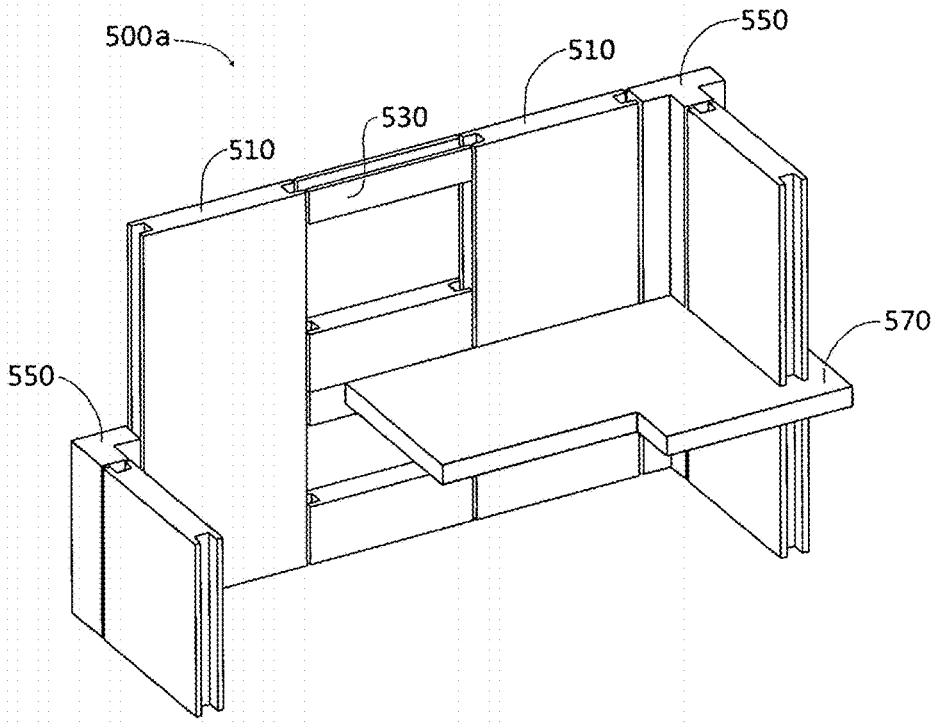
FIG. 5A is a schematic perspective view of a building with a frame structure including a modular concrete wall panel system having a plurality of modular concrete wall panels, wall columns and floor structure.
Figure 5B:
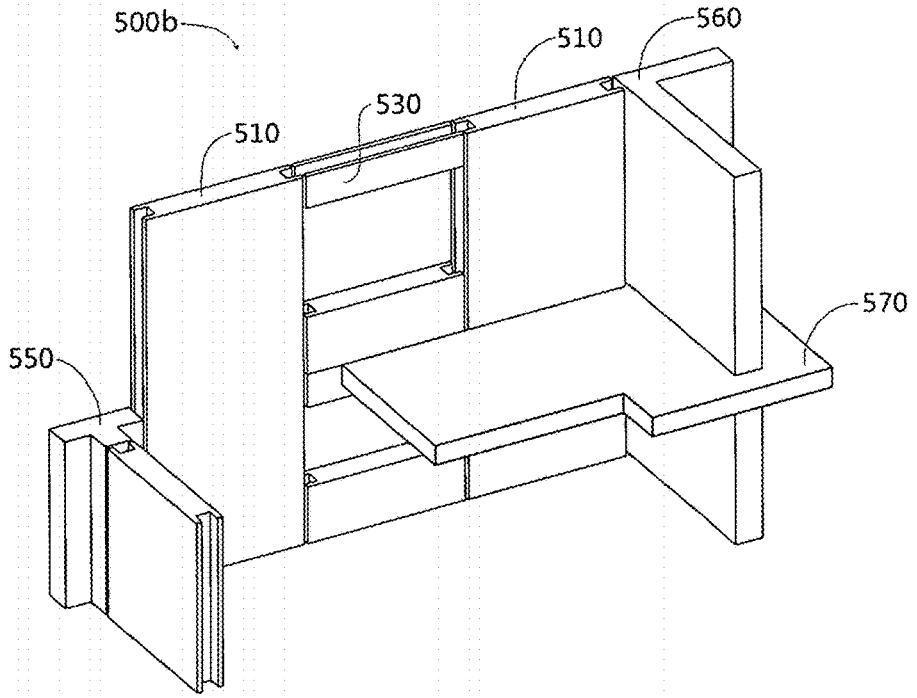
FIG. 5B is a schematic perspective view of a building with a frame-shear structure including a modular concrete wall panel system having a plurality of modular concrete wall panels, shear wall structure, wall columns and floor structure.

FIGS. 5A and 5B illustrate embodiments of buildings of a frame structure 500*a* and a frame-shear wall structure 500*b*, respectively. Such building includes a modular concrete wall panel system and floor structure.

The modular concrete wall panel system comprises: a plurality of modular concrete wall panels 510, which are placed upwardly with the lower end setting on a structural base (floor component 570, for example), a side of each panel is positioned next to a side of an adjacent panel or a wall column 550 or a shear wall panel 560, the side slot of the each wall panel forming a channel between the each wall panel and the adjacent wall panel or the wall column or the shear wall panel; wherein, the channel is installed there through a plurality of steel bars extending upwardly and poured into the channel with concrete to secure a solid connection of the wall panel system.

In the modular concrete wall panel system, the wall panels can be complemented with certain special components such as door frames, window frames and corner components. As shown in FIGS. 5A and 5B, for example, the wall panels 510 are complemented with a lintel 530 for window frame.

Figure 6A:
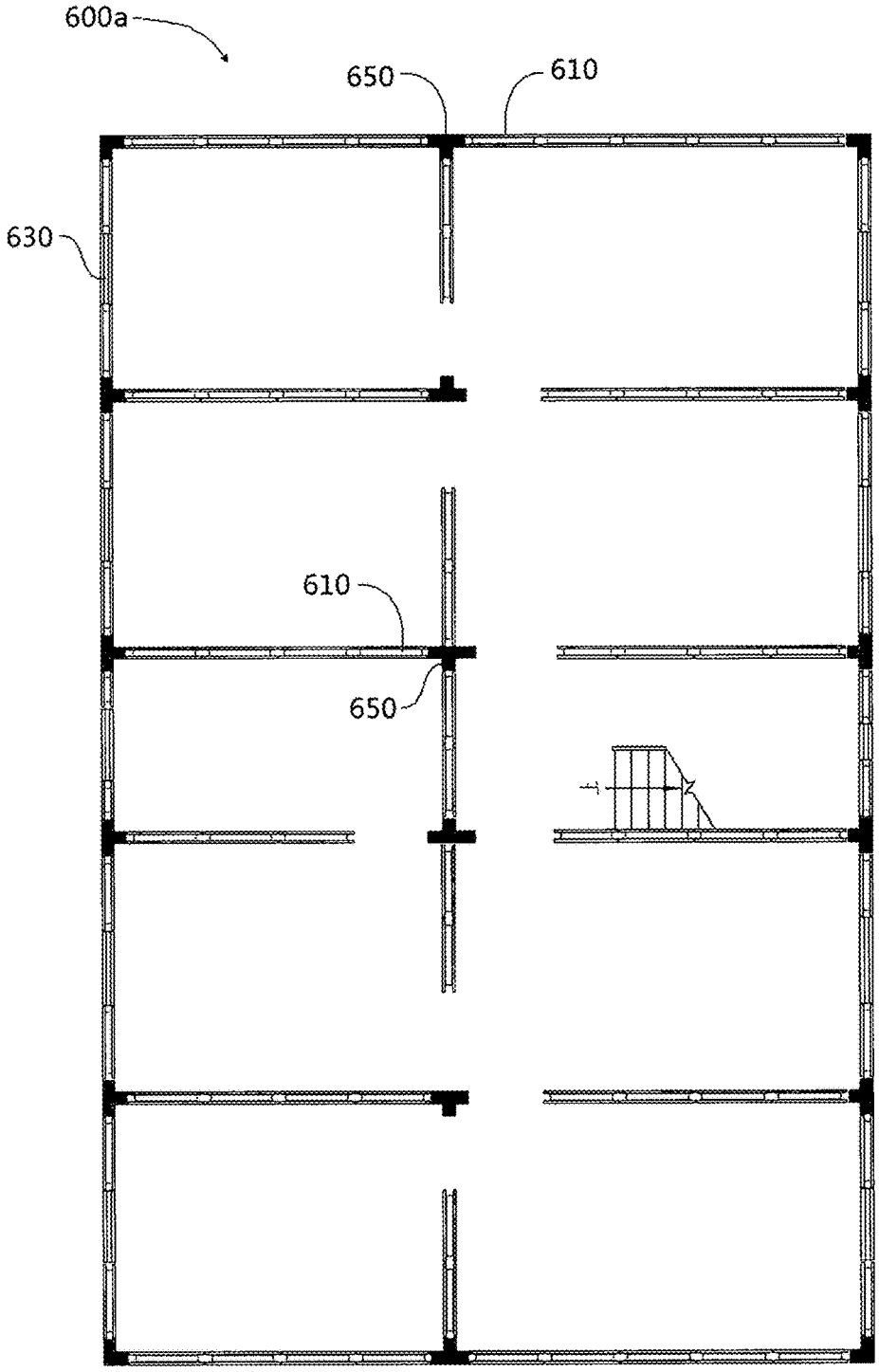
FIG. 6A is a cross-section view of a building with a frame structure including precast concrete wall panels, wall columns and floor.

FIG. 6A illustrates a building 600*a* with a frame structure including precast concrete wall panels 610, wall columns 650, lintel 630 and floor.

Figure 6B:
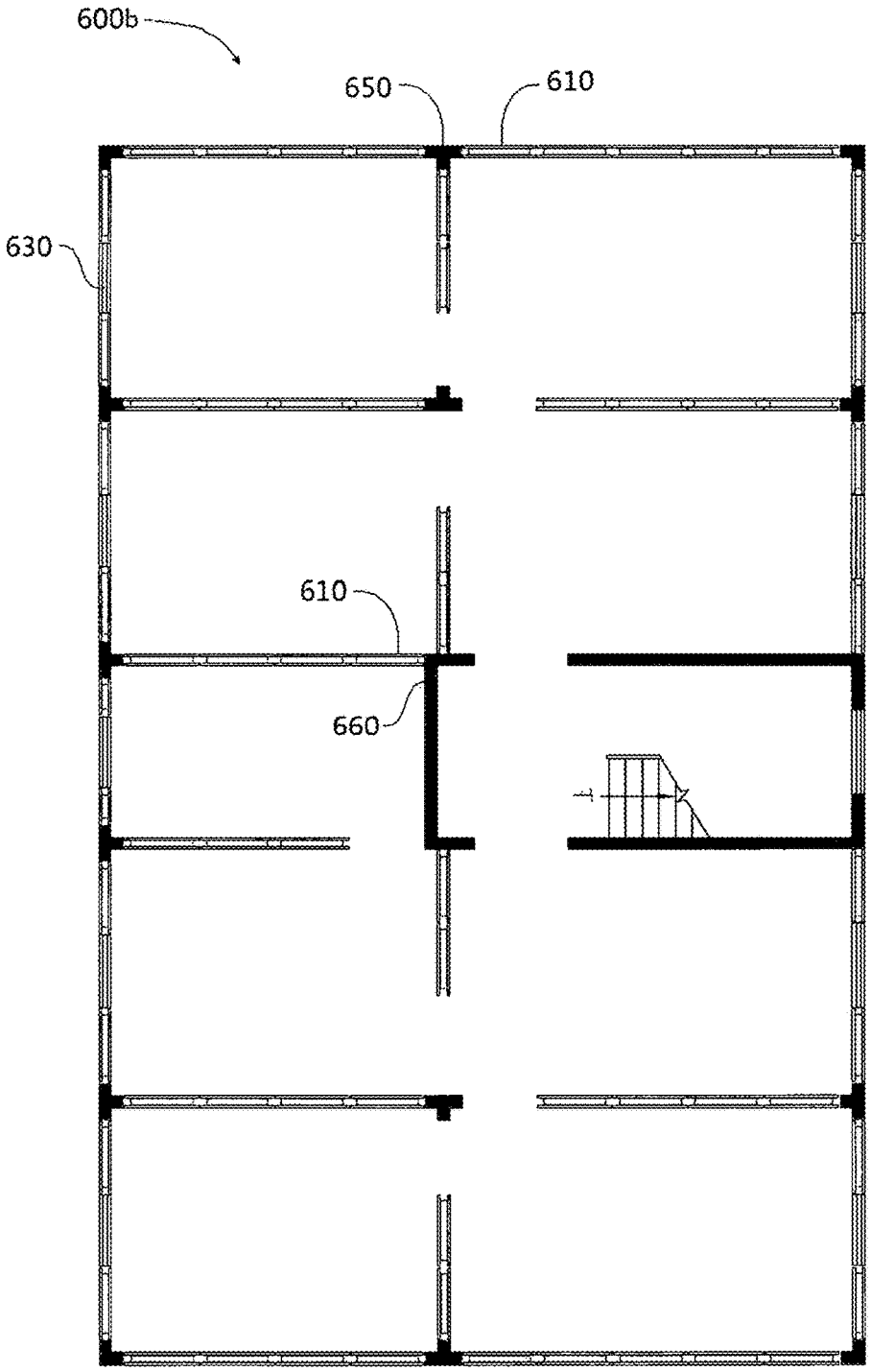
FIG. 6B is a cross-section view of a building with a frame-shear wall structure including precast concrete wall panels, shear walls, wall columns and floor structure.

FIG. 6B illustrates a building 600*b* with a frame-shear wall structure including precast concrete wall panels 610, shear walls 660, wall columns 650, lintel 630 and floor.

The modular concrete wall panel system can be used to construct a single story structure by placing steel bars pouring concrete in the groove formed by the upper slots of the wall panels. As needed, such structure can be constructed as a frame structure or a frame-shear wall structure.

The single story structure can be as one story unit or a single story building. Based on architectural needs, such one story unit can be used as the base to construct multistory unit and further to a multistory building.

In one embodiment, for constructing a building having the modular concrete wall panel system, comprising the steps of:

(1) prefabricating a plurality of the modular concrete wall panels by using a mould, including for each of the wall panels: forming a body frame with a plurality of steel bars, configuring the upper slot and the side slots, installing the insulating layer, placing the decorative layer, and pouring concrete to form the modular concrete wall panel having the rectangular body, the insulating layer and the decorative layer;

(2) assembling the modular concrete wall panel system by positioning a plurality of modular concrete wall panels upwardly with the lower ends setting on a structural base, a side of each panel being positioned next to a side of an adjacent panel or wall column or shear wall panel, the side slot of the each panel forming a channel between the each panel and the adjacent panel or the wall column or the shear wall panel;

(3) setting up a floor template by positioning the floor template horizontally on top of the wall panels and wall columns to form a structure with the wall panels and the floor template;

(4) constructing an integrated wall panel system by placing through the channel between adjacent wall panels a plurality of steel bars extending upwardly on the structural base, and placing an insulating or sealing material through the longitudinal void formed by the side grooves of adjacent installing layers;

(5) constructing a beam structure by placing a plurality of steel bars in the groove formed by the upper slots of the plurality of modular concrete wall panels, and coupling the steel bars in the groove with structure of the floor template; and (6) pouring concrete into the channels, the grooves and the floor template to form a single story building as a frame structure or a frame-shear wall structure.

The concrete used for the body of the wall panels can be regular concrete, lightweight aggregate concrete, or concrete blended or reinforced with fiber materials.

In another embodiment, the method further comprises: repeating the steps (1) through (5), on the basis of the single story building, to form a multi-story building as a frame structure or a frame-shear wall structure.

The foregoing description and drawings are provided only for the purpose of explanation and illustration of the present invention. The invention can be practiced through other embodiments or configured in various shapes, sizes, materials, and arrangements. As one of ordinary skill in the art would appreciate, the invention may be practiced with all suitable modifications and equivalents which still remain within the spirit and scope of the present invention.

The invention claimed is:

1. A precast modular concrete wall panel, comprising:

a rectangular body, having a first face and a second face, an upper end and a lower end, and a first side and a second side, wherein an upper slot is formed along the upper end, and a first and second side slots are respectively formed along the first and second sides, and the body has a concrete structure with a plurality of steel bars therein for reinforcement, wherein the upper slot runs through the entire length of the upper end, the side slots run through the entire length of the sides, respectively, such that the upper slot is connected to each of the side slots;

a sandwich layer, embedded in the concrete structure between the first face and the second face; a plurality of longitudinal dovetail groves being formed in two faces of the sandwich layer; and the sandwich layer being formed of lightweight materials;

an insulating layer attached on the second face; and a decorative layer attached on the insulating layer;

wherein in two sides of the insulating layer are formed two side grooves, which have a cross-section shape of semicircular, rectangular, trapezoidal or triangular.

2. A precast modular concrete wall panel system, comprising:

a plurality of modular concrete wall panels, each of the panels including:

a rectangular body, having a first face and a second face, an upper end and a lower end, and a first side and a second side, wherein an upper slot is formed along the upper end, and a first and second side slots are respectively formed along the first and second sides, and the body has a concrete structure with a plurality of steel bars therein for reinforcement;

a sandwich layer, embedded in the concrete structure between the first face and the second face, and the sandwich layer being formed of lightweight materials;

an insulating layer attached on the second face, the insulating layer having two side grooves formed respectively in two sides of the insulating layer; and a decorative layer attached on the insulating layer;

wherein, a longitudinal void is formed by the side grove of the insulating layer with adjacent insulating layer or wall column or shear wall panel, the void being installed there through an insulating or sealing material;

wherein, the plurality of modular concrete wall panels are placed upwardly with the lower end setting on a structural base, a side of each panel is positioned next to a side of an adjacent panel or a wall column or a shear wall panel, the side slot of the each panel forming a channel between the each panel and the adjacent panel or the wall column or the shear wall panel; and wherein, the channel is installed there through a plurality of steel bars extending upwardly, and into the channel is poured with concrete to secure a solid connection of the wall panel system.

3. The precast modular concrete wall panel system of claim 2, wherein the upper slot is greater in depth of slot comparing to the side slots.

4. The precast modular concrete wall panel system of claim 2, wherein the upper slot and the side slots have independently a cross-section shape of trapezoidal, rectangular, circular or triangular.

5. The precast modular concrete wall panel system of claim 2, wherein in two sides of the insulating layer are formed two side grooves, which have a cross-section shape of semicircular, rectangular, trapezoidal or triangular.

6. The precast modular concrete wall panel of claim 1, wherein the upper slot is greater in depth of slot comparing to the side slots.

7. The precast modular concrete wall panel of claim 1, wherein the upper slot and the side slots have independently a cross-section shape of trapezoidal, rectangular, circular or triangular.

* * * * *